United States Patent [19]

Spensberger

[11] Patent Number: 4,646,040

[45] Date of Patent: Feb. 24, 1987

[54] GAS PERMEABLE SINTERED WAVEGUIDE WALL

[75] Inventor: Wilhelm Spensberger, Munich, Fed. Rep. of Germany

[73] Assignee: Max-Planck-Gesellschaft zur Foerderung der Wissenschaften e.V., Goettingen, Fed. Rep. of Germany

[21] Appl. No.: 750,885

[22] Filed: Jul. 1, 1985

[30] Foreign Application Priority Data

Jul. 24, 1984 [DE] Fed. Rep. of Germany ..... 3427283

[51] Int. Cl.[4] ..... H01P 3/12; H01P 1/00

[52] U.S. Cl. ..... 333/239; 333/248

[58] Field of Search ..... 333/239, 242, 248, 252

[56] References Cited

U.S. PATENT DOCUMENTS 2,557,261 6/1951 Collard ..... 333/248 X
2,577,146 12/1951 Norton ..... 333/252 X
4,297,662 10/1981 Gross et al. ..... 333/252
4,323,867 4/1982 Temes ..... 333/239

FOREIGN PATENT DOCUMENTS 228843 8/1963 Austria .
892150 10/1953 Fed. Rep. of Germany .

OTHER PUBLICATIONS

Taschenbuch der Hockfrequenztechnik by H. Meinke and F. W. Gundlach, p. 42 (Springer-Verlag 1968).

*Primary Examiner*—Paul Gensler
*Attorney, Agent, or Firm*—Brumbaugh, Graves, Donohue & Raymond

[57] ABSTRACT

A hollow waveguide element for waveguide systems for microwaves has a wall consisting at least partially of a sintered material to permit gas exchange between the interior and outer surroundings of the waveguide element. With highly loaded gas-filled waveguides this makes it possible to easily carry away discharge products caused by arcing in the interior of the waveguide.

8 Claims, 2 Drawing Figures

GAS PERMEABLE SINTERED WAVEGUIDE WALL

The present invention relates to hollow waveguide systems. More specifically, the invention relates to a waveguide element for gas-filled waveguide systems for microwaves of predetermined nominal wavelength which permits a gas exchange between the interior of the waveguide system and the outer surroundings.

BACKGROUND OF THE INVENTION

Waveguide systems for high microwave powers of for example several 100 kW per waveguide at frequencies up to substantially above 300 MHz are required for example in plasma physics, fusion reactors, particle accelerators and the like. At frequencies of about 100 GHz the waveguides already have relatively small diameters so that at high microwave powers in the interior of the waveguides very high electrical field strengths occur. To cope with such high electrical field strengths it is known to fill waveguides for microwaves with a gas of good insulating properties. The insulating gas filling may be pressurized. Nevertheless, the high field strengths still lead occasionally to internal arcing. When such arcing occurs gaseous compounds result which impair the dielectric strength of the gas in the interior of the waveguide. To avoid this undesirable effect of interior arcing the insulating gas disposed in the interior of the waveguide must be continuously replaced.

Austrian patent specification No. 228,843 discloses a cavity resonator whose casing consists of at least one ferrite ring whose inner surface is coated with a thin silver layer. Ferrites are admittedly made generally by a sintering technique but they are not porous.

German patent specification No. 892,150 discloses a waveguide system (cavity resonator, hollow waveguide) whose housing is internally lined with a sort of plaited high-frequency litz. Even if this lining were permeable to gas, gas exchange between the interior and exterior of the cavity would be prevented by the impermeable housing.

SUMMARY OF THE INVENTION

Hitherto, no waveguide elements exist which permit a gas exchange without simultaneously attenuating the propagation of the microwave energy or allowing microwave energy to pass to the outside.

The present invention is accordingly based on the problem of providing a hollow waveguide element which permits both an exchange of the gas disposed in its interior but nevertheless allows no microwave energy to emerge into the surroundings and does not appreciably attenuate the microwave energy propagating itself in its interior.

The invention solves this problem in that at least a portion of the wall consists of a sintered material which contains pores which pass from the inside to the outside of the wall of the cavity and the maximum dimensions of which at the inside of the wall are small compared with the nominal wavelength of the waveguide system for microwaves.

The present waveguide section or element whose wall consists entirely or partially of gas-permeable sintered material electrically conductive at least at the inner side, in particular of sintered metal, and permits a rapid gas replacement without appreciably attenuating the microwave energy. At the same time, the cooling of the wall is also improved.

The waveguide element may be a hollow waveguide section of for example rectangular, circular or elliptical cross-section and comprise at its ends openings and connections, as flanges, corresponding to those of the remaining waveguide system. Thus, the waveguide element in a waveguide system with circular cross-section may have circular openings of the same diameter as the waveguides of the remaining waveguide system and in the case of rectangular waveguides rectangular openings of the same dimensions.

The sintered material used may be sintered metals of pure metals or metal alloys. The wall of the waveguide element may however also consist of an internally porously metallized sintered ceramic. When using sintered metal the inner surface of the waveguide element may be substantially unattenuated for the propagation of microwaves of the desired wave pattern by coating with a metal of good conductivity (metal spraying, vapor deposition or electroplating). The conductive coating must not of course close the openings of the pores.

An example of embodiment of the invention will be explained hereinafter with reference to the drawings.

DESCRIPTION OF PREFERRED EMBODIMENT

Figure 1:
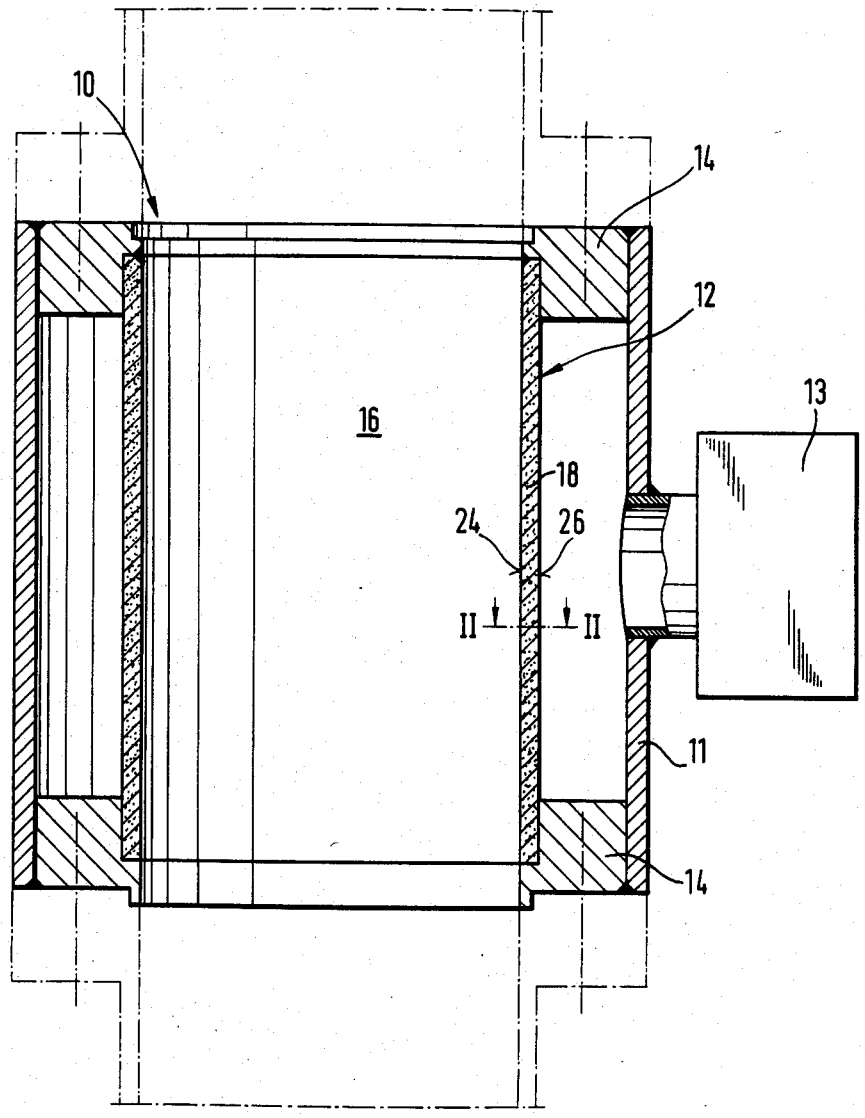
FIG. 1 is an axial section of a waveguide element for microwaves having a circular cross-section according to a preferred embodiment of the invention.

In FIG. 1 a hollow waveguide element is shown in the form of a waveguide section 10 which includes a waveguide portion 12 with a wall of circular cross-section which encloses an elongated cavity 16 open at both ends and is provided at the ends with connection flanges 14.

The waveguide portion is surrounded at the outside in spaced relationship by a gas-tight and pressure-resistant casing 11 which is connected in a gas-tight manner to the flanges 14. The casing 11 is connected to a pressurized gas system 13 through a gas connection tube. The system 13 may comprise, as known, a pressurized gas source or pump means, and valve means to supply or withdraw pressurized gas in a controlled manner to or from the respective hollow waveguide section as desired for maintaining pressure and for regulating the gas exchange from the interior of the waveguide portion to the outside.

Figure 2:
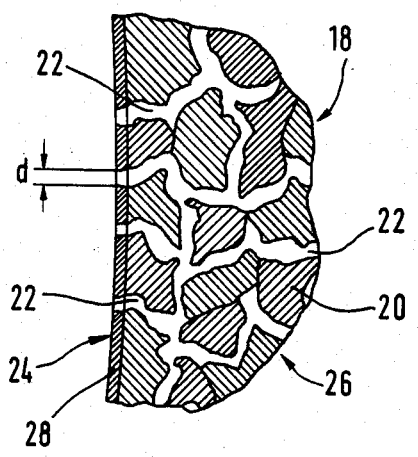
FIG. 2 is a greatly enlarged cross-sectional view of a part of the wall of the waveguide element illustrated in FIG. 1 and modified by an internal coating.

The wall 18 forming the waveguide portion 12 consists of a sintered material 20, for example sintered metal, which has open pores 22 which pass from the inside to the outside 26 of the wall 18 is illustrated in FIG. 2. The inside of the wall may carry a layer 28 of metal of good electrical conductivity, e.g. silver, which leaves the openings of the pores substantially free and which is thin compared with the thickness of the wall. The maximum dimensions d of the pores 22 are, at least at the inner side 24 of the wall, substantially smaller than the nominal wavelength of the waveguide system for microwaves, preferably less than 1/100 of the nominal wavelength.

The major portion of the wall 18 may consist of sintered ceramic and in this case the conductive layer 28 is necessary on the inside. However, it is also possible for only a portion of the wall 18 to consist of sintered material. In the case of a rectangular waveguide for example the narrow sides may be made of porous sintered material.

In a preferred embodiment, the waveguide section is a straight tubular hollow waveguide section of circular cross-section having the following parameters:

Nominal frequency: 28 GHz

Axial length: 100 mm

Internal diameter: 63.4 mm

Wall thickness of sintered material wall portion 12: 3 mm

The sintered material is a stainless steel designated X5 CrNiMo 1810 ("Siperm R" TM Deutsche Edelstahlwerke), having a particle size range of 0.2 to 1.3 mm and a maximum pore size of 65 μm. The flanges are made of copper to match the connecting waveguide portions of the system which are also made of copper. The sintered material portion 12 has no additional internal coating.

The invention may also be applied to waveguide elements other than the straight waveguide section described herein, for example directional couplers, branchings, cavity resonators and the like. In the case of a nonhomogenous current loading of the inner wall of the waveguide element the use described of sintered material may be restricted to the wall portions subjected to less load.

I claim:

1. A hollow waveguide element for a gas-filled waveguide system for electromagnetic waves of predetermined nominal wavelength, comprising a wall defining a cavity and having an inner side and an outer side, and consisting at least partially of a sintered material, said wall, at least at its inner side, adjoining a cavity of an electrically conductive material, said sintered material being provided with pores passing from the inner side to the outer side of said wall defining the cavity, said pores having a maximum dimension at the inner side of the wall which is small relative to the nominal wavelength of the waveguide system.

2. The waveguide element as defined in claim 1; and further comprising means for generating a pressure difference between the inside and outside of the wall.

3. The waveguide element as defined in claim 2; and further comprising a pressure-tight and gas-tight casing provided so as to surround the wall defining the cavity in a space relationship, and having a gas connection.

4. The waveguide element as defined in claim 1, wherein the portion of the wall consisting of sintered material has an inner surface coated with a metal of good electrical conductivity.

5. The waveguide element as defined in claim 1, wherein the sintered material is a metal.

6. The waveguide element as defined in claim 1, wherein the sintered material is a metal alloy.

7. The waveguide element as defined in claim 4, wherein the sintered material is a sintered ceramic.

8. The waveguide element as defined in claim 1, wherein the nominal wavelength is in the microwave range.

* * * * *

UNITED STATES PATENT AND TRADEMARK OFFICE

CERTIFICATE OF CORRECTION

PATENT NO. : 4,546,040

DATED : October 8, 1985

INVENTOR(S) : Rudolf SIMO et al

It is certified that error appears in the above-identified patent and that said Letters Patent are hereby corrected as shown below:

The following inventors were omitted from the letters patent:

Rudolf SIMO, Svit, Czechoslovakia

Stefan BACULAK, Poprad, Czechoslovakia

Signed and Sealed this

*Seventeenth* Day of *June 1986*

[SEAL]

*Attest:*

DONALD J. QUIGG

*Attesting Officer*

*Commissioner of Patents and Trademarks*